US005975864A

United States Patent [19]

De Santis et al.

[11] Patent Number: 5,975,864

[45] Date of Patent: Nov. 2, 1999

[54] PUMP WITH SELF-RECIPROCATING PISTONS

[75] Inventors: Gerard J. De Santis; Stanley E. Reed, both of Battle Creek, Mich.

[73] Assignee: Jetech, Inc., Battle Creek, Mich.

[21] Appl. No.: 09/026,502

[22] Filed: Feb. 19, 1998

[51] Int. Cl.[6] ..... F04B 1/107; F04B 27/047

[52] U.S. Cl. ..... 417/273; 417/523

[58] Field of Search ..... 417/271, 273, 417/521, 523, 533, 539, 545, 546, 552; 91/491, 497, 498

[56] References Cited

U.S. PATENT DOCUMENTS

| | | | |
|---|---|---|---|
| 5,100,305 | 3/1992 | Zirps | 417/523 |
| 5,123,819 | 6/1992 | Schuller et al. | 417/273 |
| 5,213,482 | 5/1993 | Reinartz et al. | 417/523 |
| 5,295,797 | 3/1994 | Kahrs et al. | 417/273 |
| 5,482,442 | 1/1996 | Blair et al. | 417/273 |
| 5,626,465 | 5/1997 | Thoma | 417/273 |
| 5,769,611 | 6/1998 | Djordjevic | 417/273 |

OTHER PUBLICATIONS

FMC *Aqua Pumps*, Dec. , 1997 (pp. 42 & 43).

Hydroblaster, Inc. *Pump Model PA–610*, advertising brochure, Dec., 1997 (1 page).

*Primary Examiner*—Willis R. Wolfe

*Attorney, Agent, or Firm*—Flynn, Thiel, Boutell & Tanis, P.C.

[57] ABSTRACT

A pump for providing a pressurized fluid flow. The pump includes a pump casing that defines a pump chamber. A pump shaft is has a head end in the pump chamber; the head end has a circumferential outer surface. The pump shaft head end has inwardly extending piston chambers. A discharge manifold is formed in the pump shaft head end. The discharge manifold has one end in fluid communication with the piston chambers and a second end in fluid communication with a discharge conduit that extends outside of the pump casing. A piston is mounted in each piston chamber. The pistons are formed with flow-through bores that provide fluid communication between the pump chamber and the piston chambers. A suction valve associated with each piston regulates fluid flow from the pump chamber through the flow-through bore into the associated piston chamber. Discharge valves regulate fluid flow from each piston chamber into the discharge manifold. The head end of the pump shaft is axially offset from the center axis of the pump chamber. As the pump shaft is rotated, the pistons engage in reciprocal motion in their piston chambers. Fluid is introduced into the pump chamber. When each piston is in its extended position, the suction valve allows fluid flow into the piston chamber. When each piston is retracted, it forces the fluid in the associated piston chamber through the discharge valve, through the discharge manifold and out the discharge conduit.

21 Claims, 7 Drawing Sheets

PUMP WITH SELF-RECIPROCATING PISTONS

FIELD OF THE INVENTION

This invention relates generally to suction pumps employed to pump large volumes of liquid-state materials and, more particularly, to a plunger pump that is self-actuating.

BACKGROUND OF THE INVENTION

Pumps are used in many industrial processes to force liquid-state fluid from a first location to a second location. Some processes require pumps that are able to discharge fluid under high pressure, 100 psi or more, and to discharge relatively large amounts of fluid, 20 gpm or more. For example, such pumps are employed in reverse osmosis systems, waste and fresh water processing plants and in pressure cleaning systems. In the past, a number of different pumps have been developed that cause the fluid to develop the requisite pressure head required to cause it to flow from its source to a destination location. Many pumps include one or more piston units that provide the pumping force that causes liquid movement.

While current pumps work reasonably well, there are some disadvantages associated with their use. Many of the current pumps include one or more linkage members that connect the pistons to the complementary drive motors. These linkages need to be lubricated and the heat they generate during use must be extracted. Consequently, it is necessary to supply many current pumps with lubricating systems in order to both lubricate and cool the internal components of the pumps. It is even necessary to provide some pumps with supplemental cooling systems to prevent the internal components of these pumps from overheating. Having to add these lubricating systems and cooling systems can significantly add to the overall cost of providing a pump. Moreover, these sub-systems, like most mechanical systems, need to be subject to periodic maintenance and have the potential to malfunction.

Moreover, many pumps are designed so that the length that their pistons travel, i.e., the piston stroke, is relatively long. For example, it is not uncommon for a piston in a conventional pump to have a 3 inch stroke. If the pump is operated at 400 RPM, the rate at which a 50 horsepower pump can operate, the total travel of an individual piston works out to approximately 2400 inches/min, (the piston stroke doubled and multiplied by the strokes per minute). Pistons traveling at these rates of speed can impose significant wear on both the pistons themselves and the associated components, the packing and the throw bushings. This high-speed piston travel also inevitably generates a significant amount of heat which further contributes to the wear of the pistons and associated components. Collectively, this heat generation and wear increase the amount of maintenance that needs to be performed on a pump.

SUMMARY OF THE INVENTION

This invention is directed to a new and improved piston pump for discharging a large volume of liquid in a high-pressure discharge stream. The pump of this invention includes a pump casing formed with a curved inner wall that defines a pump chamber. An inlet bore extends through the pump casing into an outer perimeter portion of the pump chamber. There is a pump head rotatably mounted in the pump chamber. The pump head has a circumferentially extending outer wall that is inwardly spaced from the outer perimeter of the pump chamber. The pump head defines piston chambers that extend from the outer wall to the center the pump head and a discharge manifold that extends longitudinally through the center of the pump head. The pump head is mounted in the pump chamber to rotate eccentrically relative to the inner wall of the pump casing so that as the pump head rotates, the distance between the outer wall of the pump head and the inner wall of the pump casing varies.

The pump of this invention also includes a discharge conduit mounted to the pump casing. The discharge conduit has a first end in fluid communication with the discharge manifold and a second located outside of the pump casing. A piston is disposed in each piston chamber. Springs are also disposed in the piston chambers for urging the pistons toward the inner wall of the pump casing. A suction valve in the piston allows fluid flow from the pump chamber into the piston chamber when fluid pressure in the pump chamber exceeds fluid pressure in the piston chamber by a select amount. A discharge valve is disposed between said piston chamber and said discharge manifold. The discharge valve allows fluid flow from said piston chamber into said discharge manifold when fluid pressure in said piston chamber exceeds fluid pressure in said discharge manifold by a select amount.

Owing to the axially offset relationship between the pump head and the pump casing, the rotation of the pump head causes the pistons to move reciprocally in their chambers. When an individual piston is in its fully extend state, fluid flows from the flow-through bore, through the piston and into the base of the piston chamber. As the pump shaft continues to rotate, the piston is forced inwardly, towards the center of the pump head. As a consequence of this motion, the fluid in the base of the piston chamber is forced through the outflow bore and out of the pump casing through the discharge manifold. Owing to the continual flow of fluid into some of the individual piston chambers and the simultaneous discharge of fluid out of the other piston chambers, the pump of this invention generates a continuous high pressure fluid stream.

BRIEF DESCRIPTION OF THE DRAWINGS

The invention will be pointed out with particularity in the claims. The above and further advantages of the invention may be better understood by reference to the following detailed description taken in conjunction with the accompanying drawings, in which:

DETAILED DESCRIPTION

Figure 1:
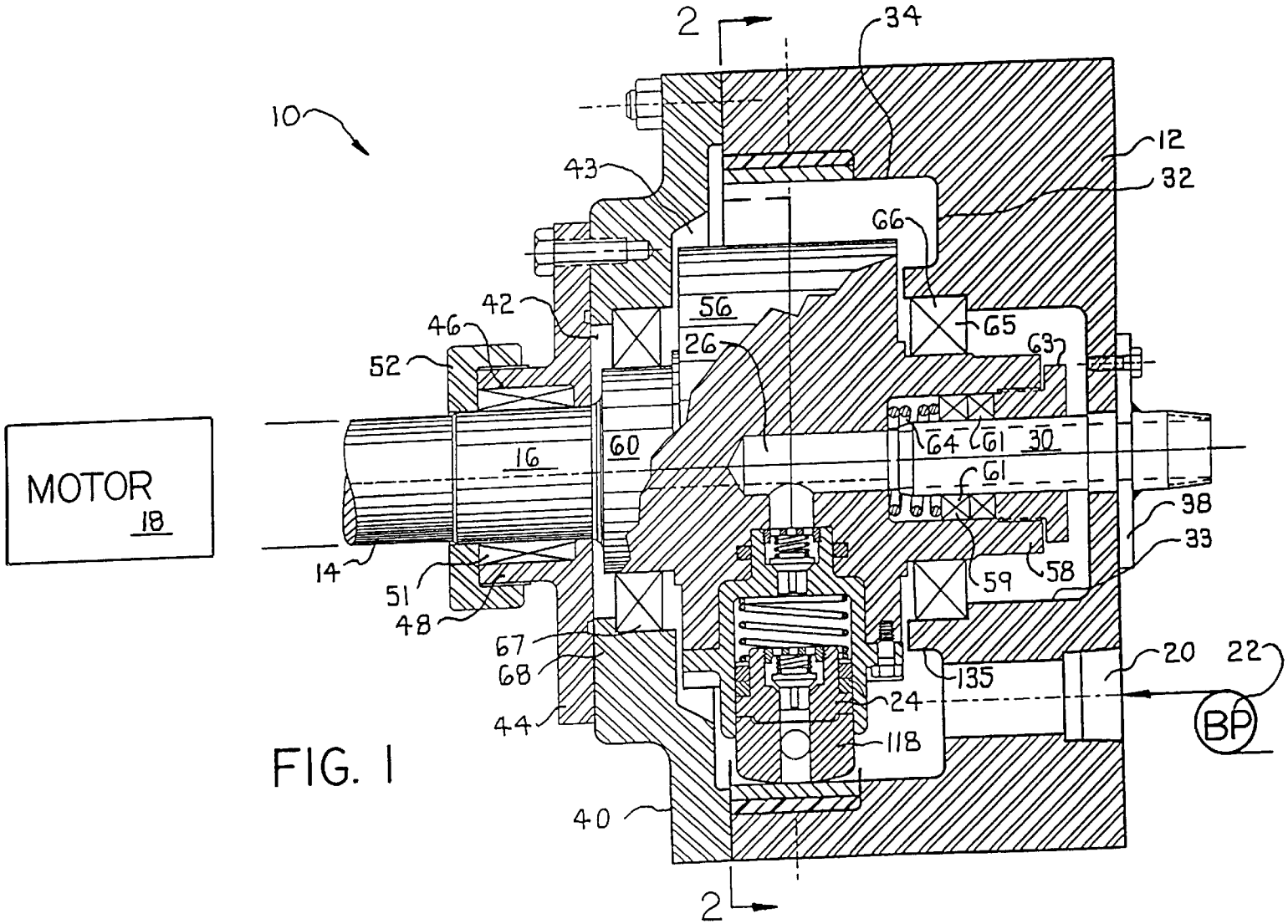
FIG. 1 is a cross sectional view of the pump of this invention taken along the longitudinal axis of the pump wherein the ancillary components that are connected to the pump are shown diagrammatically.
Figure 2:
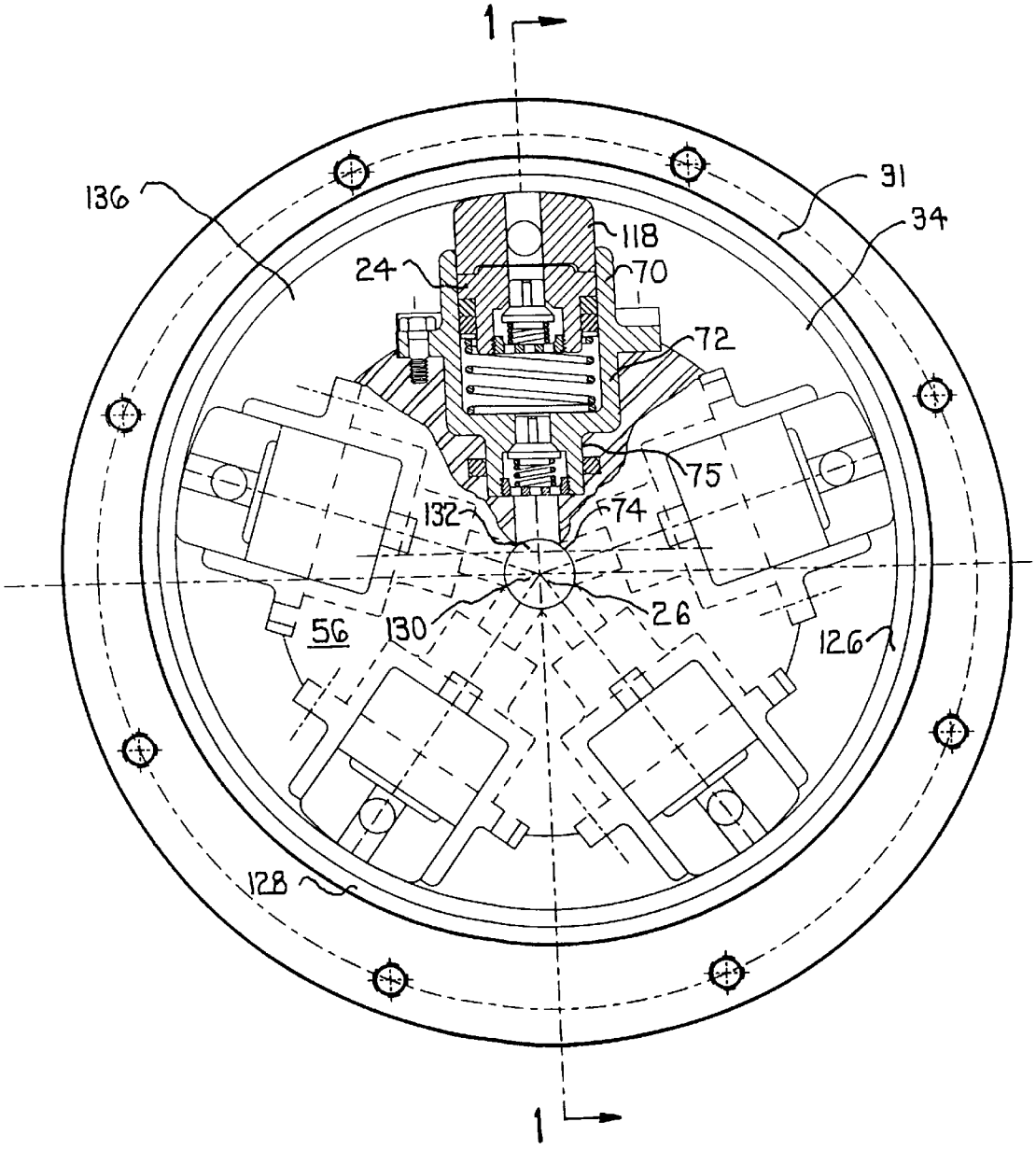
FIG. 2 is a cross section sectional view through the pump taken along line 2—2 of FIG. 1.

FIGS. 1 and 2 illustrate the pump 10 of this invention. The pump 10 includes a pump casing 12 which houses a rotating pump shaft 14. The pump shaft 14 includes a stem section 16 that extends out one end of the pump casing 12. The stem section 16 is attached to motor 18 that provides the motive power for rotating the pump shaft 14. The fluid to be pumped is introduced into the pump 10 through an inlet bore 20 formed in the pump casing 12. In this particular embodiment of the invention, the fluid is fed into the inlet bore 20 under pressure from a booster pump 22 for reasons that will be explained hereinafter. The fluid flows through pistons 24 that project outwardly from the center of pump shaft 14. The pistons 24 force the fluid into a discharge manifold 26 which is a bore formed in the pump shaft 14 that extends along the center axis of the shaft. The pumped fluid flows from discharge manifold 26 out of the pump 10 through a discharge conduit 30 mounted to the pump casing 12.

Pump casing 12 is formed from a block of metal. The interior of the pump casing 12 is hollow to define a pump chamber 32 in which the end of the pump 14 shaft distal from the motor 18 is seated. More particularly, it will be noted that the pump chamber 32 is open towards the end of the pump casing 12 that is directed towards the motor 18. In the illustrated version of the invention, the pump casing 12 is formed so that the pump chamber 32 has a first, base section 33 located adjacent the closed end of the pump casing. The pump chamber 32 also has a main section 34 that is contiguous with base section 33 and that forms the open end of the pump chamber. The pump chamber 32 is formed so that the main section 34 has a diameter larger than that of the base section 33. From FIG. 2 it will be noted that the pump chamber main section 34 is formed by an inner wall 31 of the pump casing 12. The pump casing 12 is further formed to have a lip 35 that extends around the pump chamber base section 33 into the adjacent portion of the pump chamber main section 34.

The inlet bore 20 extends from the closed end of the pump casing 32 into the pump chamber main section 34. The discharge conduit 30 extends through a bore 36 that opens into the pump chamber base section 33. The discharge conduit 30 is sleeve-like in form and extends substantially through base section 33. The discharge conduit 30 is actually welded to a mounting plate 38 that is bolted to the closed end of the pump casing 12.

A head plate 40 is bolted over the open end of pump casing 12. The head plate 40 is shaped to subtend the outer perimeter of pump chamber main section 34. The head plate 40 is further formed to have, adjacent its outer end a center opening 42. An outwardly tapered inner opening 43, integral with center opening 42, defines a transition space between the pump chamber main section 34 and center opening 32. As will be described hereinafter, portions of the pump shaft 14 extend into both the inner opening 43 and the center opening 42.

The open end of the center opening 42 of the face plate 40 is covered by a face plate 44. The face plate 44 is actually formed with its own opening 46 through which the stem section 16 of pump shaft 14 extends. More particularly, it will be noted that the face plate 44 is formed to have a hollow, outwardly directed, center-located stuffing box 48 that surrounds the opening 46. A plurality of shaft packing rings 51 located around the stem section 16 provide a liquid-tight, low friction barrier between the stem section and the inside wall of stuffing box 50. An open-ended cap 52 is threaded over the open end of stuffing box 50 to hold shaft packing rings 51 in place.

The pump shaft 14 is formed to define a head end 56 that is formed integrally with and is located at the free end of the stem section 16. The head end 56 has a diameter greater than that of the stem section 16. The head end 56 is the portion of the pump shaft 14 that is housed within the main section 34 of pump chamber 32 and the inner opening 43 of the face plate 40. The discharge manifold 26, which is formed as a cylindrical bore, is formed in head end 56.

The pump shaft 14 further has a nose 58 that extends forward of the head end 56 and a neck 60 located between the head end 56 and stem section 16. The nose 58 has a diameter approximately equal to that of the stem section 16 and is disposed in the pump chamber base section 33. The nose 58 is formed with an axially extending center bore 59 into which the discharge manifold 26 opens. The end of discharge conduit 30 extends into the bore 59. A plurality of shaft packing rings 61 fitted around the outside of the discharge conduit 30 provide a liquid-tight seal across the gap between the discharge conduit 30 and the inner wall of the nose 58 that defines the bore 59. The shaft packing rings 61 are held in place by a gland 63 that screws into bore 59. Gland 63 has a center opening, not identified, through which the discharge conduit 30 extends. A spring 64 extends between the base of the bore 59 to the innermost shaft packing ring 61. The spring 64 extends around the end of the discharge conduit adjacent the open end of discharge manifold 28. The spring 64 biases the shaft packing rings 61 outwardly to ensure that they maintain a liquid-tight seal around the discharge conduit 30.

A bearing assembly 65 provides a low-friction interface between the outer surface of the nose 58 and an adjacent inner surface of the pump casing 12 that defines the pump chamber base section 33. The outer race of the bearing assembly 65 (not illustrated) is set in an outwardly stepped space 66 defined by the inner wall of the pump chamber 32 that defines the base section 33. In preferred versions of the invention, the bearing assembly 65 is a thrust bearing assembly designed to provide a low friction interface when a longitudinal load is imposed on the pump shaft 14.

The neck 60 has a diameter between that of head end 56 and the stem section 16 and is disposed in the center opening 42 of face plate 40. A bearing assembly 67 provides a low friction interface between the neck 60 and the adjacent inner wall of face plate 40 that defines the center opening 42. It will be noted that the head plate 40 is further provided with an inwardly directed lip 68 that extends into center opening 42. The outer race of bearing assembly 67 (not illustrated) actually abuts a side wall of lip 68 so that the lip prevents outward movement of the bearing assembly. Bearing assembly 67, like bearing assembly 65, is a thrust bearing assembly.

Figure 3:
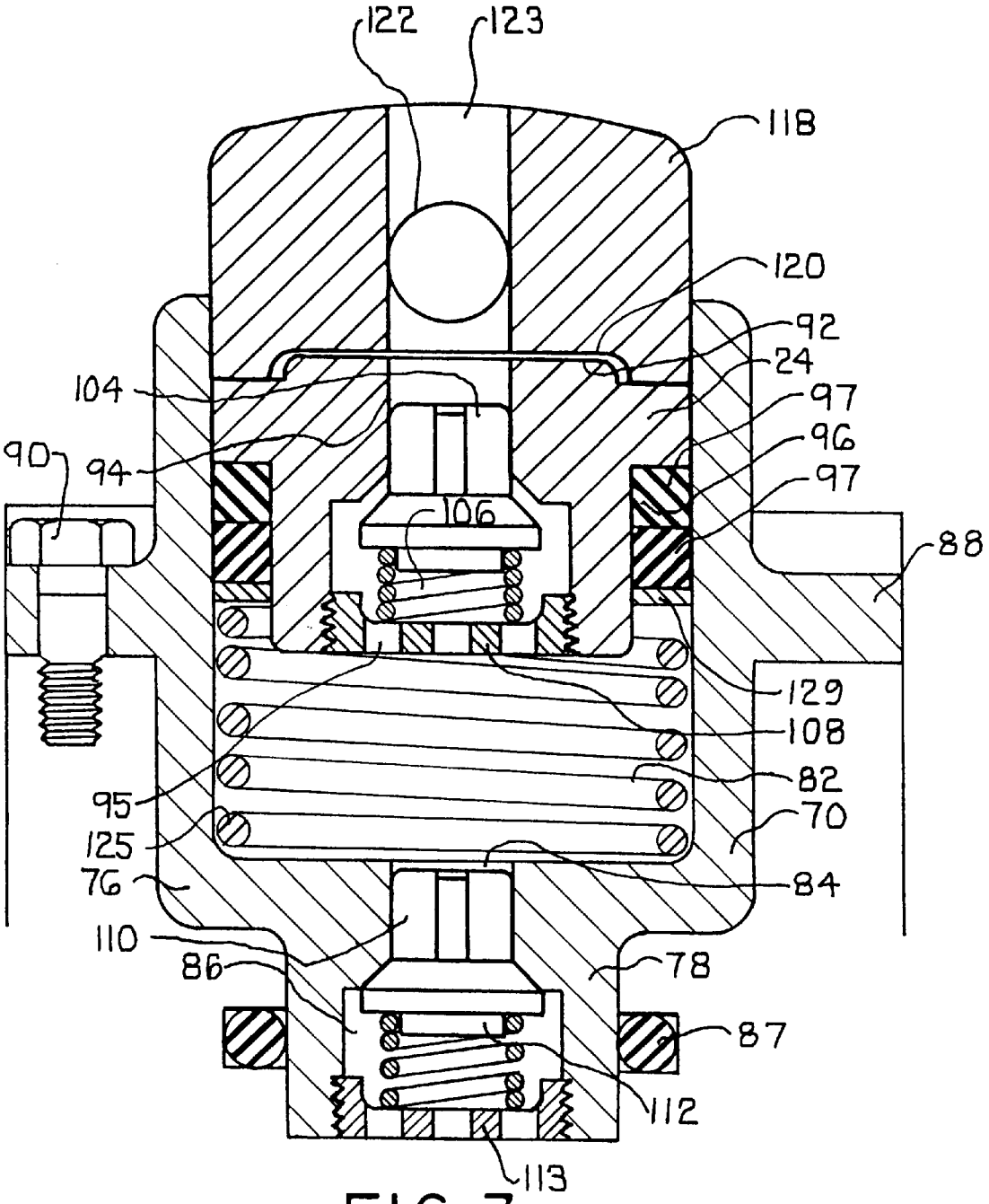
FIG. 3 is an enlarged cross sectional view of a piston and associated components.

The depicted version of the pump 10 of this invention is provided with five pistons 24, best described by reference to FIGS. 2 and 3. Each piston is seated in a stuffing box 70 that is mounted to and extends radially outwardly from the head end 56 of the pump shaft 14. To accommodate the stuffing boxes 70, the head end 56 is formed with five piston bores 72 that extend inwardly from the outer perimeter of the head end. Integral with each piston bore 72 is a secondary bore 74. The secondary bores 74 have a diameter less than that of the complementary piston bores 72 and open into the discharge manifold 26. Each secondary bore 74 has a counterbore 75 that opens into the complementary piston bore 72.

Each stuffing box 70 has a main body 76 that seats partially in and extends out of the associated piston bore 72. Integral with the main body 76 there is a reduced-diameter stem 78 that seats in the adjacent counterbore 75. The stuffing box main body 76 is formed so as to define a piston chamber 82. An outflow bore 84 extends through the stem 78 from the piston chamber 82 and opens into the secondary bore 74. In the depicted version of the invention, the end of the outflow bore 84 that opens into discharge manifold 26 is provided with a counterbore 86. An O-ring 87 seated in a groove formed around the counterbore 75 of the secondary bore 74 internal to head end 56, forms a seal around the outside of the stuffing box stem 78 (groove not identified).

An annular flange 88 extends around the outside of the main body 76 around the portion of the main body that extends away from the pump shaft head section 56. Threaded fasteners 90 that extend through the flange 88 into openings in the head section 56 secure the stuffing box to the pump shaft 12, (openings in the flange and pump shaft not illustrated.)

Each piston 24 is a generally solid member that is seated in the piston chamber 82 of the associated stuffing box 70. Each piston 24 is shaped to have a raised top 92 the purpose of which will become clear hereinafter. A flow-through bore 94 extends axially through the piston 24. The flow-through bore 94 is provided with a counterbore 95 that opens towards the base of the piston chamber 82. The piston 24 is further formed so that the bottom two-thirds thereof, the portion located closest the base of piston chamber 82, has an inwardly stepped circumferential outer wall 96. A plurality of packing rings 97 are seated in the upper end of the annular space between the inner wall of the stuffing box 70 and outer wall 96.

A suction valve 104 controls fluid flow from the flow-through bore 94 into the base of piston chamber 82. The suction valve 104 is a solid member with a tapered upper surface that seats against a complementary tapered transition section between flow-through bore 94 and counterbore 95 (tapered surface and tapered wall not identified). A spring 106 that is seated against an open-ended cap 108 threadedly secured in counterbore 95 abuts suction valve 104. The spring 106 thus normally holds the suction valve 104 in the closed state against the complementary surface of the piston 24.

A discharge valve 110 regulates fluid flow through the outflow bore 84 into the associated secondary bore 74 of the pump shaft head end 56 and the discharge manifold 26. The discharge valve 110 has a tapered top surface that seats against a tapered wall that forms a transition section between the outflow bore 84 and the associated counterbore 86. A spring 112 that is seated against an open-ended cap 113 that is threadedly secured in counterbore 86 of the outflow bore abuts discharge valve 110. The spring 112 holds the discharge valve 110 in the normally closed position.

A plunger stroker 118 is seated on top of each piston 24 and serves as the outermost component of each piston sub-assembly. The plunger stroker 118 is formed so that the base end thereof has an indentation 120 in which the raised top 92 of the piston 24 is seated. The plunger stroker 118 also formed so that in the top section thereof there is an X-shaped flow conduit 122. A flow-through bore 123 concentric with and having the same diameter of the flow-through bore 94 of the piston 24 extends through plunger stroker 118. The flow-through bore 123 extends through the center of the flow conduit 122.

A spring 125 is seated in each piston chamber 82 and extends between the base of the chamber and a throw bushing or washer 129 located under the packing rings 97. The springs 125 thus push the pistons 24 and associated plunger strokers 118 outwardly toward the outer perimeter of the pump chamber 32.

Inner and outer rings 126 and 128, respectively, form a bearing assembly between the top ends of the plunger strokers 118 and the adjacent inner wall of the pump casing 12 that defines the pump chamber 32. Both the inner ring 126 and the outer ring 128 are formed as sleeve-like members. The inner ring 126 is formed of a metal such as a duplex stainless steel. Outer ring 126 is formed of a low-friction plastic such as sold under the trademark Teflon. The outer ring 126 is securely fitted against the adjacent inner wall of the pump casing 12 and does not rotate. The inner ring 126 is capable of free rotation. It will, however, be understood that the inner ring 126 typically rotates at a rate less than that at which the adjacent pump shaft 14 rotates.

While the head end 56 of the pump shaft 14 is seated in pump casing 12, it should be understood that the pump shaft is axially offset with the longitudinal axis of the pump chamber 32. This is seen best by reference to FIG. 2 wherein the center axis of the pump shaft, represented by point 130, is spaced from the center axis of the pump chamber 32, represented by point 132. As a result of this offset, the arcuate section of the head end 56 of the pump shaft 14 located adjacent the inlet bore 20 is located further from the opposed the inner wall of pump casing 12 than the section of head end distal from the inlet bore. Thus, as the head end 56 rotates, the distance between any fixed point on the outer surface of the head end and the opposed inner wall of the pump casing 12 will change.

The pump shaft 14 only contacts the walls of the pump casing along shaft packing rings 61, thrust bearings 65 and 67 and along the interface between the top surfaces of the plunger strokers 118 and inner ring 126. Consequently, within the pump chamber 32 there is an interstitial void space 136 between the pump shaft 14 and the adjacent inner walls of the pump casing 12 that define the pump chamber. This interstitial space 136 surrounds the nose 58, the front and rear surfaces of the head end 56, the neck 60 and the front end of the stem section 16 of the pump shaft 14.

The motor 18 is any suitable motor for rotating the pump shaft 14. Typically, the motor 18 is an electrically driven motor with a rotor to which the pump shaft 14 is directly tied and is capable of rotating the shaft at rates of 600 to 3,600 RPM and, in still more preferred versions of the invention, between 1,200 to 1,800 RPM. The booster pump 22 is any suitable pump for pressurizing the liquid that is to be pumped by pump 10 before it is introduced into inlet bore 20. Typically, a suitable booster pump 22 for use with pump 10 is configured to discharge fluid at pressures of up to 200 psi.

Figure 4:
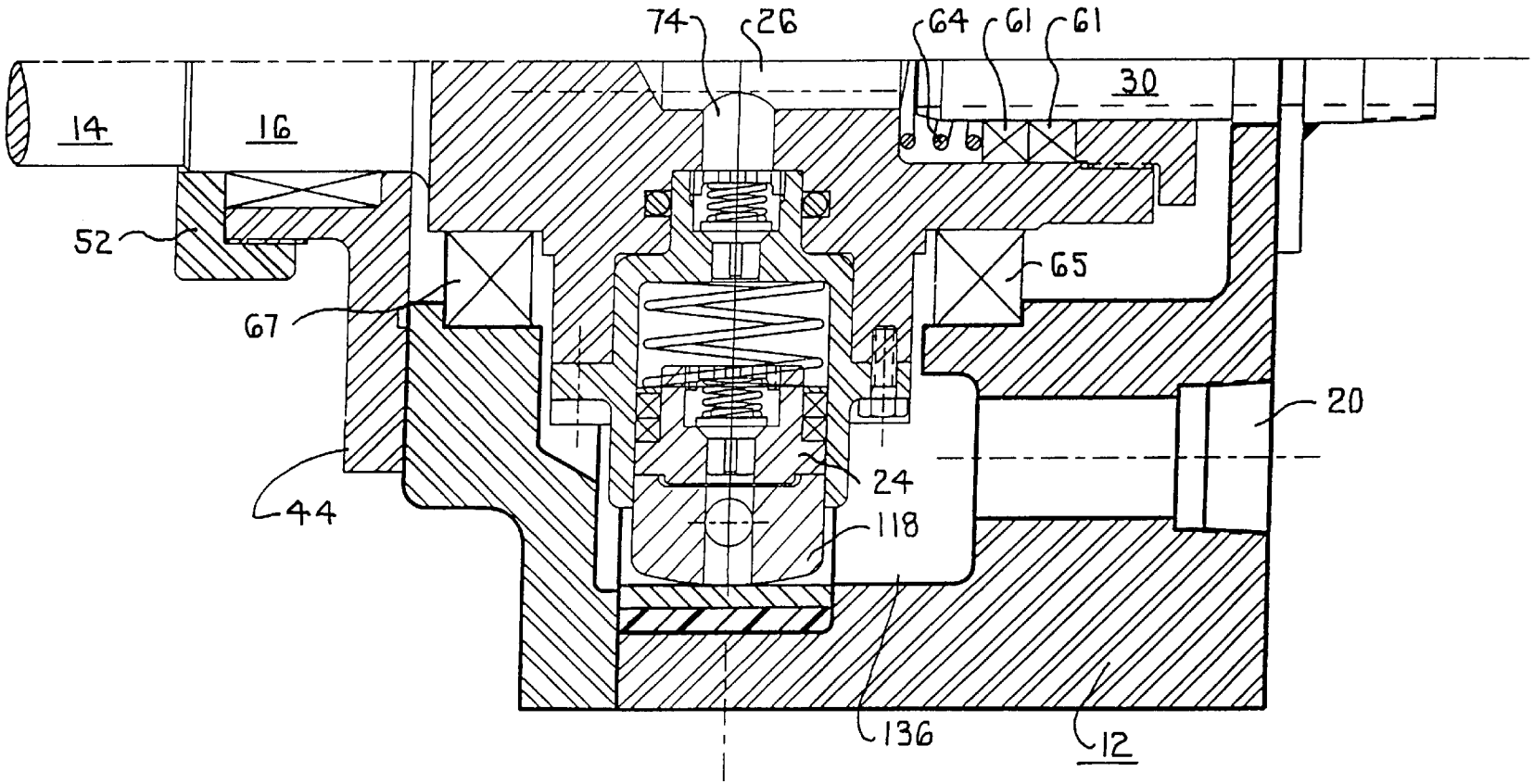
FIG. 4 is an enlarged cross-sectional view of the pump depicting the state of a piston and associated piston chamber when they are in the suction state.

The pump 10 of this invention is operated by rotating the pump shaft 14 with the motor 18 and introducing the fluid to be pump into the inlet bore 20 from booster pump 22. The fluid then flows from inlet bore 20 into the interstitial space 136 that surrounds the head end 56 of pump shaft 14. As the pump shaft 14 rotates, each piston 24 is rotated through an arc wherein the adjacent inner wall of the pump casing is relatively distal from the piston. When the piston 24 transits this arc, centrifugal force acts on the piston to push the piston out of the piston chamber 82 as seen best in FIGS. 1 and 4. When the piston 24 is in this stage, it is referred to as being in the suction state. As the piston 24 is urged into the suction state, the free space within the piston chamber 82 becomes a low-pressure zone. As, discussed hereinafter, when the piston 24 is in this position, the associated discharge valve 110 is held closed. The liquid in the interstitial space 136 flows into the plunger stroker flow conduit 122, the plunger stroker flow-through bore 123 and the piston flow-through bore 94. Since this fluid is under pressure from the booster pump 22 and since the piston chamber is under suction pressure, the fluid opens suction valve 104 and flows into the low-pressure zone formed within the piston chamber 82.

Figure 5:
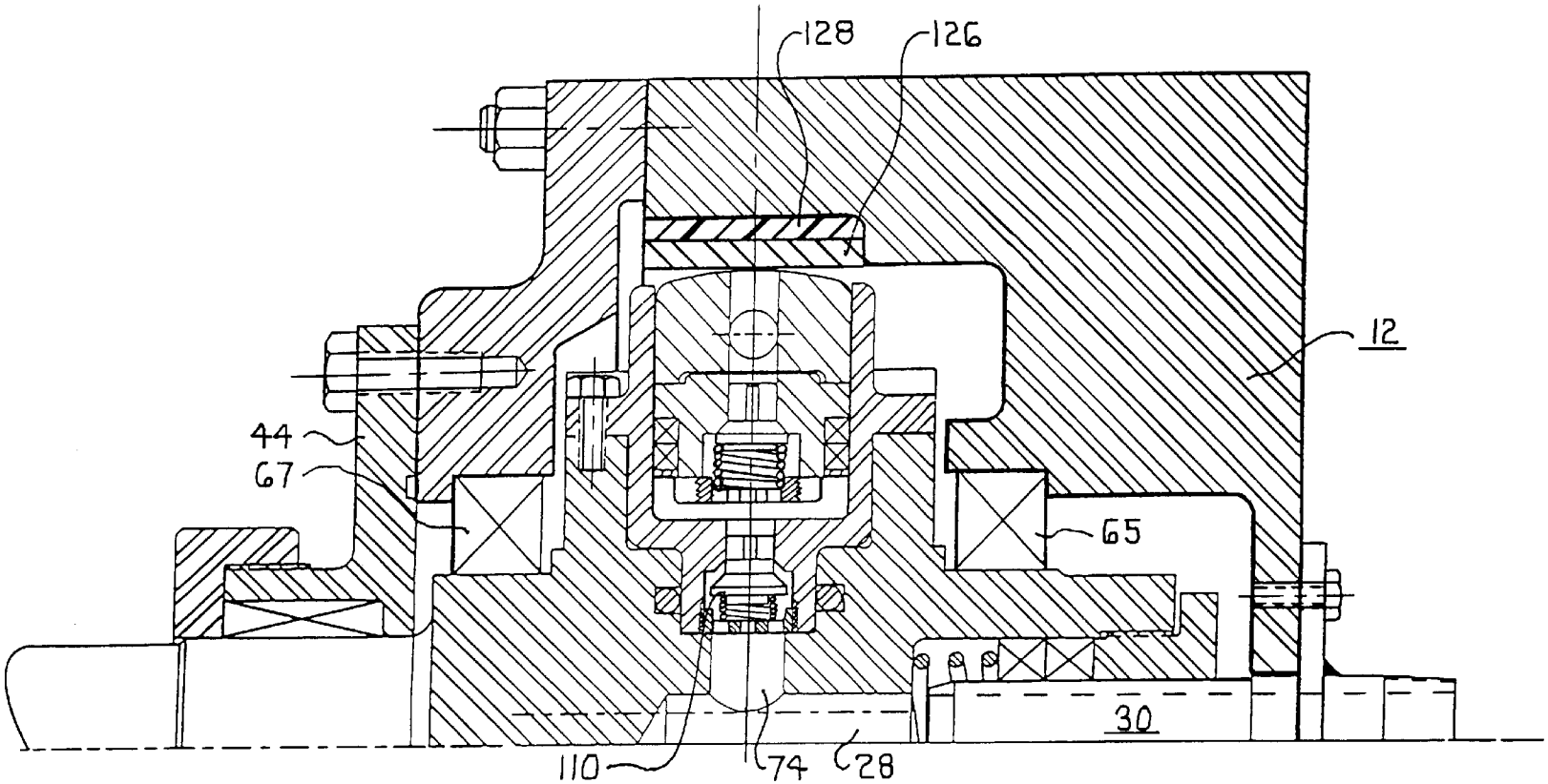
FIG. 5 is an enlarged cross-sectional view of the cross sectional view of the pump depicting the state of a piston and the associated piston chamber when they are in the discharge state.

As the pump shaft 14 continues to rotate, the piston 24 transits an arc in which the distance between the head end 56 of the pump shaft 14 and the adjacent inner wall of the pump casing 12 decreases. The plunger stroker 118 and the underlying piston 24 are pushed inwardly towards the base of the piston chamber 82 as depicted by FIG. 5. When the piston 24 is in this stage, it is referred to as being in the discharge state. As a result of this inwardly directed displacement of the piston 24, the piston pressurizes the fluid previously drawn into the piston chamber 82. The pressurization of this fluid creates a back force that closes the suction valve 104. The pressurization of this fluid also provides a force that overcomes the spring 112 holding the discharge valve 110 closed. Thus, the discharge valve 110 is opened by the inwardly directed force of the pressurized fluid and the fluid flows through the outflow bore 78 into the discharge manifold 26 from which it is discharged from the pump 10.

The continued rotation of the pump shaft 14 causes the piston 24 to cycle from the discharge state back to the suction state. This is the transition in which piston chamber 82 develops a low pressure relative to the pressure in the interstitial space 136. As a result of this low pressure developing, there are no forces acting against spring the 112 and the pressurized liquid contained within discharge manifold 26. Thus, the forces generated by spring 112 and the pressurized liquid contained within the discharge manifold 26 are sufficient to return discharge valve 110 to the closed state and to hold the valve 110 in this state while the piston is in the suction state.

During the operation of the pump 10 of this invention, at least one of the pistons 24 is forcing fluid out of the discharge manifold at very high pressure. More specifically, versions of this invention can be employed to discharge fluid at a rates of between 50 to 70 gpm at pressures of 1000 to 1500 psi. It will further be noted that the pistons 24 are moved along their reciprocating paths of travel solely as result of the forces imposed by the springs 125 and the inwardly direct forces imposed on the plunger strokers. There are no linkages connected between the pump shaft and the pistons. Thus, the pump 10 of this invention does not have any ancillary components that need to be lubricated in order to facilitate its operation.

Still another feature of the pump of this invention is that the shaft 14 can be directly connected to the shaft of the motor 18 with which the pump is used. Thus, there is no need to provide either increase or reduction gears to transfer the motive power developed by the motor to the pump. Since the pump 10 of this invention does not require an intermediate gear assembly, the cost of both providing and maintaining the pump is further kept to a minimum.

Also, the fluid that is introduced into the pump does not simply flow into the piston chambers 82. The fluid also flows into the interstitial space 136 that surrounds the portions of the pump shaft 14 disposed within the pump casing 32. Since the flow conduit 122 in the plunger stroker 118 is double ended, the fluid is drawn into the piston chambers 82 through both sides of the head end 56. Thus, the fluid not only is present around the pump shaft 14, it is forced to circulate around the pump shaft. Consequently, the fluid being pumped serves as coolant to extract heat generated around the interfaces between the pump casing 12 and the pump shaft 14. Since the fluid being pumped serves as a coolant, the pump 10 of this invention does not require a ancillary cooling system to remove the heat generated as a consequence of its operation. Thus, since the pump 10 of this invention does not require either a lubrication system or a cooling a system the costs of providing and maintaining these system is eliminated.

The rings 126 and 128 serve as the interface between the outer surfaces of the plunger strokers 118 and the adjacent circumferential inner wall of the pump casing 12. These rings 126 and 128 function as a low friction interface that minimize wear of the plunger strokers 118. The rings, which are relatively economical to provide, eliminate the need to provide more costly roller bearing assemblies as the interface between the plunger strokers 118 and the pump casing. Moreover, the elimination of a roller bearing assembly to serve as this interface eliminates the need to have to ensure that the roller bearing assembly is kept lubricated.

Moreover, the pistons 24 of the pump 10 have a relatively short stroke. More particularly, in versions of the invention designed to discharge fluid at a rates of 50 to 70 gpm, the individual pistons typically have a stroke of 1.5 inches or less. In even more preferred versions of the invention, the actual piston stroke may be 0.625 inches or less. In a pump 10 having a piston stroke of 0.625 inches that is operated 1800 RPM, the total travel of each piston is 2160 inches/minute. Thus, when the pump 10 of this invention is operated at relatively high speed, the pistons 24 internal to the pump still only travel at relatively slow rates. This slow rate of travel both reduces the internal heat developed by the piston and the wear of the piston and its associated components.

Still another feature of pump 10 of this invention is that the plunger strokers 118 are simply seated over the complementary pistons 24; these two components are not rigidly connected together, they are capable of free lateral movement relative to each other. When a plunger stroker 118 is subjected to side loading forces as a result of the drag that develops between the plunger stroker and the adjacent inner ring 126, the plunger stroker flexes relative to the associated piston 24. This flexing minimizes the extent to which the side loading forces are transmitted through the plunger stroker 118 to the piston 24. Since the pistons 24 are not subjected to large amounts of side loading, their ability to move in a reciprocal pattern is not significantly restricted.

Figure 6:
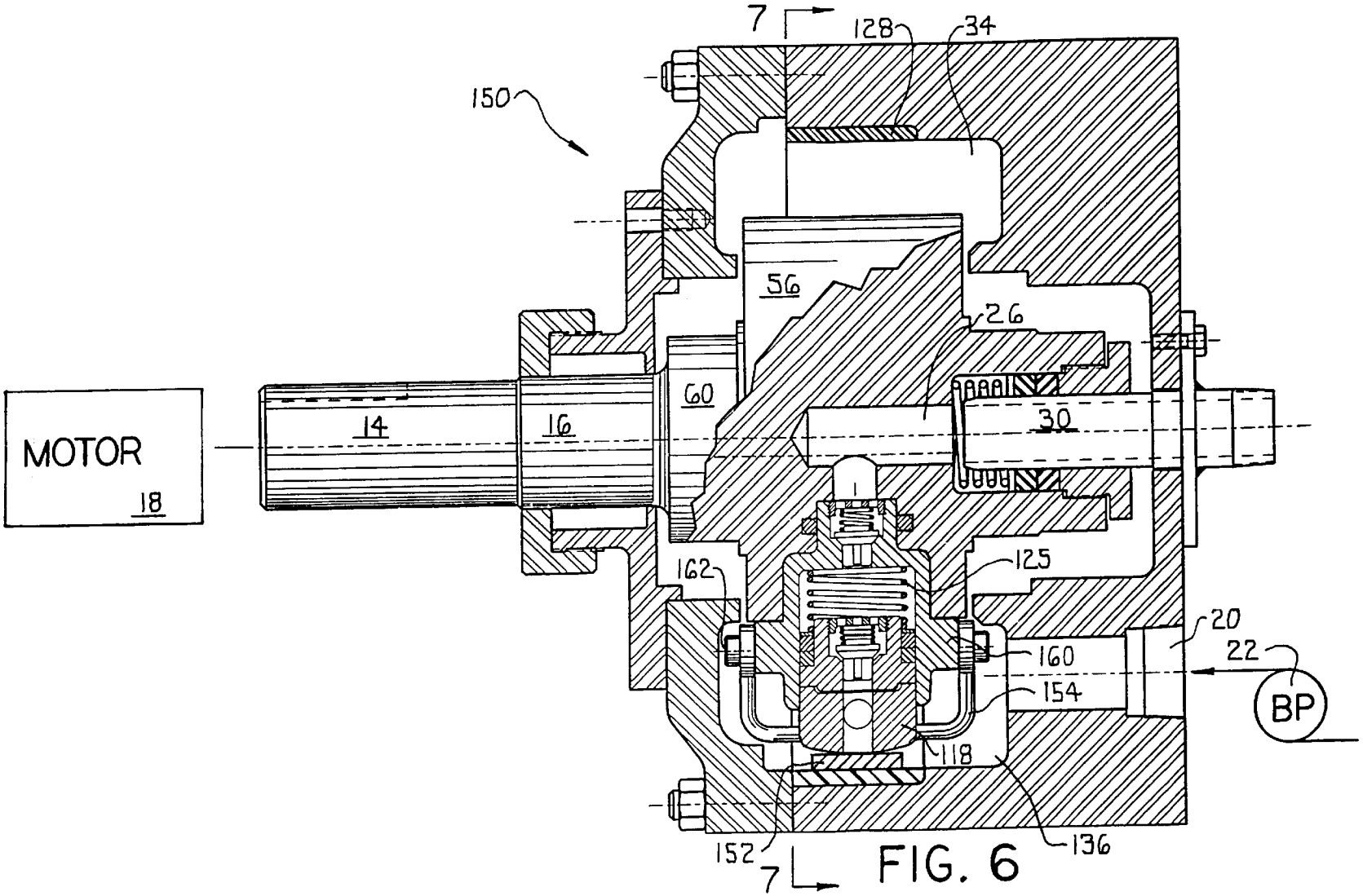
FIG. 6 is a cross sectional view of an alternative pump assembly of this invention.
Figure 7:
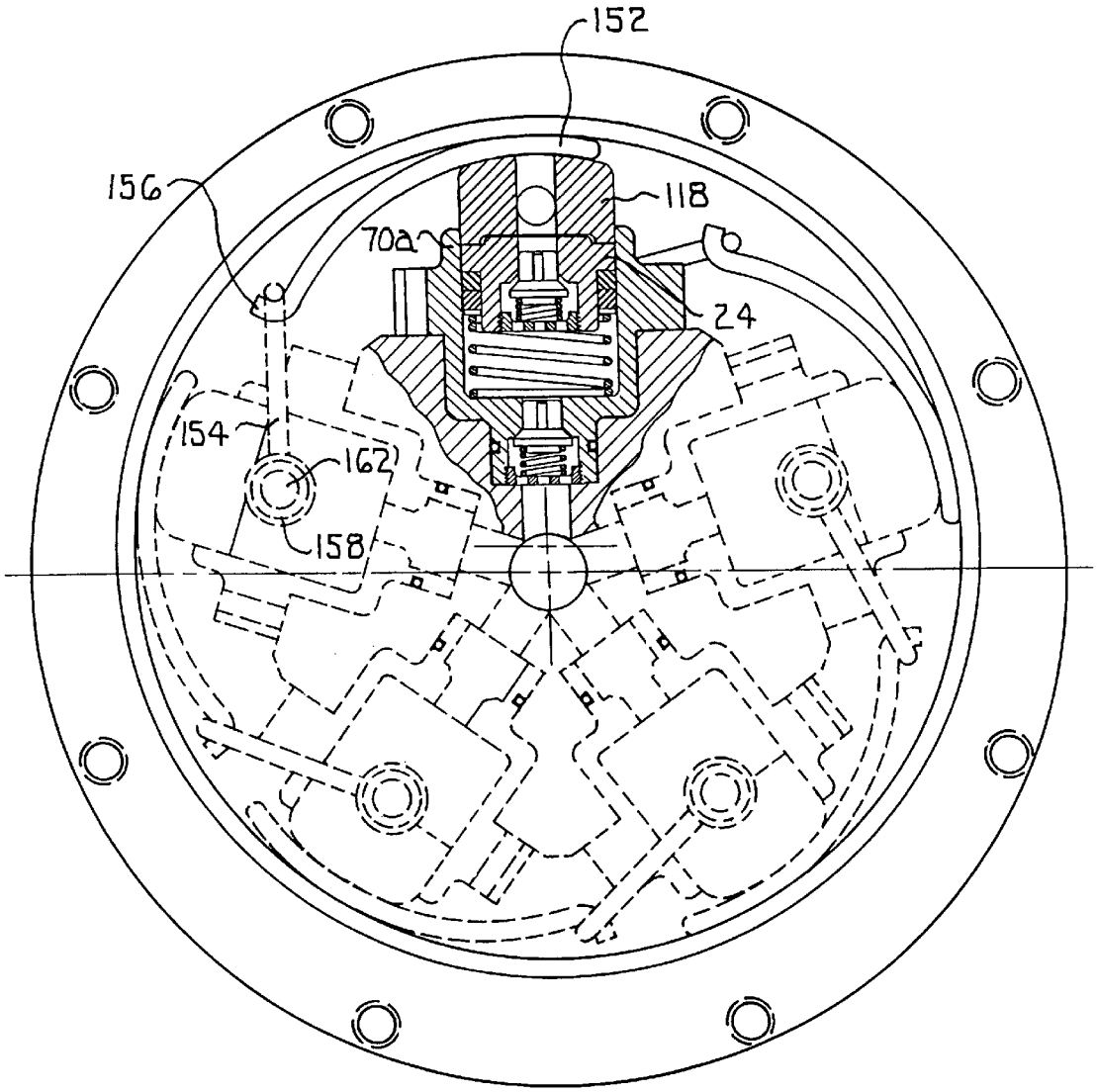
FIG. 7 is a side view of the pump of FIG. 6 taken along line 7—7.

FIGS. 6 and 7 illustrate an alternative pump 150 of this invention. The pump 150 includes the same basic components as the above-described pump 10. However, instead of the previously-described inner ring 126, the pump 150 includes a plurality of pivoting shoes 152 that function as the intermediate elements between the plunger strokers 118 and the outer ring 128. Each shoe 152 is formed from a generally flat sheet of metal such as section of duplex stainless steel that is approximately 0.25 inches thick. The shoes 152 are shaped to have a slightly arcuate profile so that they are inwardly curved heading into the direction in which the pump shaft 14 rotates.

Each shoe 152 is secured to a mounting bracket 154 that itself is pivotally secured to the stuffing box 70*a* positioned in front of plunger stroker 118 that abuts the shoe. By "in front of" it is understood that the shoe 152 is connected to the stuffing box 70*a* that rotates across a given line before the shoe and associated plunger stroker 118 rotate across the same line.

The mounting bracket 154 is a U-shaped member that is formed out of a rod-like stainless steel material. Each shoe 152 is formed with an outwardly curved lip 156 that is welded to the cross element of the bracket 154. The opposed ends of the bracket 154 are each formed with eye-loops 158 to facilitate the securement of the bracket to the stuffing box 70*a*. The stuffing box 70*a* has the same basic structure as previously described stuffing box 70 (FIG. 1). The stuffing box 70*a* is further formed to have two opposed bosses 160 that project beyond the sides of the stuffing box that extend above the outer perimeter of head end 56. The mounting bracket 154 is positioned so that the eye-loops 158 abut the opposed faces of bosses 160. Threaded fasteners 162 extend through the eye-loops 158 and the boss 160 to pivotally secure the mounting bracket 154 to the stuffing box 70*a*, (openings in the bosses through which the fasteners extend not illustrated.)

The pump 150 operates in the same general manner as the pump 10. Still a further feature of the pump 150 is that the shoes 152 serve as the components of the pump that are subjected to side loading as the shaft 14 is rotated. Since the shoes 152 are not rigidly connected to plunger strokers 118, only a small fraction of the side load forces are, in turn, transmitted to the plunger strokers. Since the plunger strokers 118 are not exposed to significant side loading, the fraction of the side load forces transmitted to the pistons 24 is even further reduced. This further reduction in the side loading of the pistons 24 further enhances the ability of the pistons to move in a reciprocal pattern in the stuffing boxes 70*a*.

The foregoing description has been limited to specific embodiments of this invention. It will be apparent however, from the description, that alternative constructions can be practiced. For example, while in the disclosed version of the invention there are five pistons 24 in the head end 56 of the pump shaft 14, in still other versions of the invention there may be more or less pistons. In some versions there may even be a single piston. Also, in some versions of the invention, the stuffing boxes in which the pistons are seated may be integrally formed as part of the head end of the pump shaft. It should likewise be recognized that there is no requirement that the plunger strokers always be components that are separate from the complementary pistons.

Still, in other versions of the invention, the seals associated with the pistons may not travel with the pistons. In other words, the seal may be fixed in the pump head to provide a liquid-tight barrier between the pistons and the pump head. Often, in pumps of these configurations, the pistons are referred to as plungers.

It should likewise be recognized that other bearing assemblies may be provided to form the low-friction interfaces between the head end 56 of the pump shaft 14 and the pump casing 12. For example, metallic and non-metallic bearing rings may perform this function. In some versions of the invention, these bearing assemblies may be combination of both metallic and non-metallic bearings.

In some versions of the invention, the centrifugal force acting on the pistons may provide all the force that is needed to move the pistons outwardly. The need to provide the springs 125 to initially set the pistons 24 and/or assist in their outward movement may be eliminated.

Also, it should be recognized that it may not always be necessary to operate the pump 10 of this invention in combination with a booster pump. In some versions of the invention, especially those in which the shaft is rotated at a relatively low speed, the fluid to be pumped may have a sufficient pressure head that it will automatically overcome the forces holding the suction valves 104 closed and flow into the piston chambers 82.

Moreover, other methods may be employed to minimize the amount of side loading to which the pistons 24 are exposed. For example, in some versions of the invention, three or more rings may be imposed between the heads of the plunger strokers and the inner wall of the pump casing 12 that defines the pump chamber 32. Alternatively, roller bearings may be mounted in the pump casing to serve as the low-side loading intermediate components. Also, it should likewise be realize that the pump casing and complementary components may have alternative constructions. For example, in some versions of the invention, the closed end of the pump casing may be the end from which the pump shaft extends. In these versions of the invention, the discharge conduit would extend from the face plate. Also, in still other versions of the invention; the inlet bore 20 may have a position different from what has been described. Therefore, it is an object of the appended claims to cover all such modifications and variations as come within the true spirit and scope of the invention.

The embodiments of the invention in which an exclusive property or privilege is claimed are defined as follows:

1. A pump, said pump including:

a pump casing, said pump casing being formed with a curved inner wall that defines a pump chamber and an inlet bore extending into an outer perimeter portion of said pump chamber;

a pump head rotatably mounted in said pump chamber, said pump head having a center and a circumferentially extending outer wall that is inwardly spaced from said outer perimeter of said pump chamber, said pump head defining at least one piston chamber that extends from said outer wall to the center of said pump head and a discharge manifold that extends longitudinally through the center of said pump head, wherein said pump head is mounted in said pump chamber to rotate eccentrically relative to said inner wall of said pump casing so that as said pump head rotates, the distance between a point on said outer wall of said pump head and said inner wall of the pump casing varies;

a discharge conduit mounted to said pump casing, said discharge conduit having a first end that is disposed in said pump chamber and is in fluid communication with said discharge manifold and a second end in fluid communication with said first end that is located outside of said pump casing;

a piston disposed in said piston chamber, said piston having a flow-through bore that provides a fluid communication path between said pump chamber and said piston chamber;

a biasing member disposed in said piston chamber for urging said piston toward said inner wall of said pump casing;

a suction valve in said flow-through bore of said piston for allowing fluid flow from said pump chamber into said piston chamber when fluid pressure in said pump chamber exceeds fluid pressure in said piston chamber by a select amount; and a discharge valve disposed between said piston chamber and said discharge manifold for allowing fluid flow from said piston chamber into said discharge manifold when fluid pressure in said piston chamber exceeds fluid pressure in said discharge manifold by a select amount.

2. The pump of claim 1, wherein said inner wall of said pump casing has a circular profile so that said pump chamber has a circular profile, said outer wall of said pump head has a circular profile and said pump head is mounted in said pump chamber so that said pump head is axially offset relative to a center axis of said pump chamber.

3. The pump of claim 1, further including a shaft extending from said pump head, said shaft extending out of said pump casing.

4. The pump of claim 1, wherein: said pump head is provided with a plurality of said pistons, each said piston being disposed in a separate piston chamber defined in said pump head; and separate said discharge valves are located between each said piston chamber and said discharge manifold for controlling fluid flow from said piston chambers to said discharge manifold.

5. The pump of claim 1, wherein a plunger stroker is fitted over a head end of said at least one piston so that said plunger stroker extends beyond said outer wall of said pump head and said biasing member urges said plunger stroker towards said inner wall of said pump casing, said plunger stroker being formed with a flow-through bore for establishing fluid communication between said pump chamber and said flow-through bore of said piston and said plunger stroker being capable of lateral movement independent of lateral movement of said piston.

6. The pump of claim 5, wherein a bearing assembly is located between said plunger stroker and said inner wall of said pump casing, said bearing assembly including at least one ring capable of rotating relative to said pump casing.

7. The pump of claim 5, further including a shoe located between said plunger stroker and said inner wall of said pump casing, said shoe being pivotally attached to said pump head to both rotate with said pump head and to move with longitudinal movement of said plunger stroker.

8. The pump of claim 1, wherein a bearing assembly is located between said piston and said inner wall of said pump casing, said bearing assembly including at least one ring capable of rotating relative to said pump casing.

9. The pump of claim 1, further including a shoe located between said piston and said inner wall of said pump casing, said shoe being pivotally attached to said pump head to both rotate with said pump head and to move with longitudinal movement of said piston.

10. A pump assembly including:

a pump casing, said pump casing being formed with: an inner wall having a circular profile so as to define a circular pump chamber, said pump chamber having a center axis; and an inlet bore that extends into an outer perimeter portion of said pump chamber;

a pump head rotatably disposed in said pump chamber, said pump head having a center axis and being formed with: a circumferentially extending, circular outer wall; a plurality of piston chambers located around said outer wall that extend towards said pump head center axis; a discharge manifold that extends longitudinally along said pump center axis; and a plurality of secondary bores, each said secondary bore extending between a separate one of said piston chambers and said discharge manifold wherein, said pump head is axially offset from said pump chamber center axis, so that, as said pump head rotates, the distance between a point on said outer wall of said pump head and said inner wall of said pump casing varies;

a discharge conduit mounted to said pump casing, said discharge conduit having a first end located in said pump chamber that is in fluid communication with said discharge manifold and a second end located outside of said pump casing that is in fluid communication with said first end;

a plurality of piston assemblies, each said piston assembly being seated in a separate one of said piston chambers and including: a piston seated in said piston chamber; a plunger stroker seated in said piston chamber above said piston and dimensioned to extend beyond said outer wall of said pump head, said plunger stroker being fitted over said piston to move laterally relative to said piston; and a biasing spring located in said piston chamber for urging said piston and said plunger stroker outwardly toward said inner wall of said pump casing wherein, said piston and said plunger stroker are each formed with a flow-through bore, said flow-through bores being positioned to allow fluid flow from said pump chamber into said piston chamber;

a plurality of suction valves, each said suction valve being positioned in a separate said piston flow-through bore for allowing fluid flow through said flow-through bore when fluid pressure in said pump chamber exceeds fluid pressure in said piston chamber by a set amount; and a plurality of discharge valves, each said discharge valve being located in a separate one of said secondary bores for allowing fluid flow through said secondary bore and into said discharge manifold when fluid pressure in said secondary bore exceeds fluid pressure in said discharge manifold.

11. The pump assembly of claim 10, further including a plurality of shoes, each said shoe being located between a separate said plunger stroker and said inner wall of said pump casing and being pivotally connected to said pump head to rotate with said pump head and to move with longitudinal displacement of said plunger stroker with which said shoe is associated.

12. The pump assembly of claim 11, further including a race disposed between said shoes and said inner wall of said pump casing.

13. The pump assembly of claim 10, further including a plurality of stuffing boxes mounted to said outer wall of said pump head, each said stuffing box defining a separate one of said piston chambers.

14. The pump assembly of claim 13, further including a plurality of shoes, each said shoe being located between a separate said plunger stroker and said inner wall of said pump casing and being pivotally connected to said pump head to rotate with said pump head and to move with longitudinal displacement of said plunger stroker with which said shoe is associated.

15. The pump assembly of claim 10, further including a bearing assembly located between said plunger strokers and said inner wall of said pump casing.

16. The pump assembly of claim 15, wherein said bearing assembly includes an outer race located adjacent said inner wall of said pump casing and an inner race located between said outer race and said plunger strokers, said inner race being configured to rotate relative to said outer race.

17. A method of providing a pressurized fluid flow including the steps of:

providing a pump casing having an inner wall that defines a cylindrical pump chamber, an inlet bore into said pump chamber and a discharge conduit having a first end located in said pump chamber and a second end located outside of said pump casing;

providing a pump head with a plurality of pistons in said pump chamber, said pump head having a center axis, a circular outer wall, a plurality of piston chambers that extend from said outer wall towards said center axis and a discharge manifold, said discharge manifold having one end in fluid communication with said piston chambers and a second end in fluid communication with said first end of said discharge conduit wherein each said piston is seated on one of said piston chambers and is formed with a flow through bore that allows fluid communication between said pump chamber and said piston chamber in which said piston is seated;

rotating said pump head and said pistons so that, during said rotation, said pistons are moved reciprocally in and out of said piston chambers;

introducing fluid into said pump chamber under pressure so that said fluid flows into said piston flow-through bores;

when fluid pressure in each said piston flow-through bore exceeds fluid pressure in said piston chamber with which said flow-through bore is associated by a select amount, allowing fluid flow from said flow-through bore into said piston chamber; and when fluid pressure in each said piston chamber exceeds fluid pressure in said discharge manifold, allowing fluid flow from said piston chamber to said discharge manifold so that said fluid will flowthrough said discharge manifold and out of said discharge conduit.

18. The method of providing pressurized fluid flow of claim 17, wherein said pump head has opposed front and rear surfaces that are spaced inwardly from adjacent surfaces of said pump chamber so that when fluid is introduced into said pump chamber, said fluid flows around said front and rear surfaces of said pump head.

19. The method of providing pressurized fluid flow of claim 17, wherein said pistons are moved reciprocally in and out of said piston chambers by:

positioning said pump head in said pump chamber so that said pump head is axially offset relative to said pump chamber so that as said pump head rotates the distance between a fixed point on said pump head and said inner wall of said pump casing varies; and biasing said pistons outwardly towards said inner wall of said pump casing so that as said pump head is rotated, said pistons are moved reciprocally in and out of said piston chambers.

20. The method of providing pressurized fluid flow of claim 17, wherein a plunger stroker is provided over each said piston, each said plunger stroker being able to move laterally relative to said piston with which said plunger stroker is associated, so that when said pistons are subjected to said outward biasing, said plunger strokers are located between said pistons and said inner wall of said pump chamber.

21. The method of providing pressurized fluid of claim 20, further including the step of providing a separate shoe between each said plunger stroker and said inner wall of said pump chamber, each said shoe being pivotally attached to said pump head so that as said pump head, said pistons and said plunger strokers engage in said rotation, said shoe rotates with said plunger stroker with which said shoe rotates and engages in longitudinal movement with said plunger stroker.

* * * * *